US007263923B2

(12) United States Patent
Urschel et al.

(10) Patent No.: US 7,263,923 B2
(45) Date of Patent: Sep. 4, 2007

(54) FOOD PRODUCT CUTTING APPARATUS AND PROCESS

(75) Inventors: Patrick C. Urschel, Valparaiso, IN (US); Mike Jacko, Chesterton, IN (US); Brent Bucks, Valparasio, IN (US); Paul E. Arrasmith, Valparasio, IN (US)

(73) Assignee: Urschel Laboratories, Inc., Valparaiso, TN (US)

( * ) Notice: Subject to any disclaimer, the term of this patent is extended or adjusted under 35 U.S.C. 154(b) by 429 days.

(21) Appl. No.: 10/707,526

(22) Filed: Dec. 19, 2003

(65) Prior Publication Data

US 2004/0118259 A1 Jun. 24, 2004

Related U.S. Application Data

(60) Provisional application No. 60/319,798, filed on Dec. 19, 2002.

(51) Int. Cl.
*B26D 7/06* (2006.01)

(52) U.S. Cl. ..... 83/444; 83/703; 83/932

(58) Field of Classification Search ..... 83/444, 83/446, 703–705, 932
See application file for complete search history.

(56) References Cited

U.S. PATENT DOCUMENTS

| | | | | |
|---|---|---|---|---|
| 1,539,749 | A | 5/1925 | Lederer | |
| 2,006,643 | A * | 7/1935 | Leo | 83/444 |
| 2,572,770 | A * | 10/1951 | Shadduck | 83/435.15 |
| 2,610,664 | A * | 9/1952 | Thompson | 83/420 |
| 3,217,768 | A * | 11/1965 | Lamb | 83/404.2 |
| 3,318,351 | A | 5/1967 | Werder | 146/94 |
| 3,842,727 | A * | 10/1974 | Glenn et al. | 99/592 |
| 4,050,339 | A * | 9/1977 | Soleri | 83/703 |
| 4,228,963 | A * | 10/1980 | Yamauchi et al. | 83/444 |
| 4,397,206 | A | 8/1983 | Czala | 83/399 |
| 4,436,012 | A | 3/1984 | Hochanadel | 83/703 |
| 4,644,838 | A * | 2/1987 | Samson et al. | 83/444 |
| 4,813,317 | A | 3/1989 | Urschel et al. | 83/356.3 |
| 4,852,441 | A | 8/1989 | Anders et al. | 83/155 |
| 5,038,649 | A | 8/1991 | Hoaglin | 83/440 |
| 5,241,902 | A | 9/1993 | Gangi | 99/538 |
| 5,385,074 | A * | 1/1995 | Burch, Jr. | 83/932 |
| 5,694,824 | A * | 12/1997 | Jacko et al. | 83/403 |
| 6,460,444 | B2 * | 10/2002 | Jacko | 83/932 |
| 6,602,533 | B1 | 8/2003 | Smith et al. | 426/438 |

FOREIGN PATENT DOCUMENTS

| | | |
|---|---|---|
| GB | 2290946 | 6/1995 |

* cited by examiner

*Primary Examiner*—Stephen Choi
(74) *Attorney, Agent, or Firm*—Gary M. Hartman; Domenica N. S. Hartman; Hartman & Hartman

(57) ABSTRACT

An apparatus and process for cutting food products, in which the products are fed single-file by gravity through a cutting device comprising one or more cutting elements. The apparatus makes use of a device for contacting and positioning the products as they drop through a feed passage prior to encountering the cutting device so as to produce size-reduced products of more uniform size.

17 Claims, 6 Drawing Sheets

FOOD PRODUCT CUTTING APPARATUS AND PROCESS

CROSS REFERENCE TO RELATED APPLICATIONS

This application claims the benefit of U.S. Provisional Application No. 60/319,798, filed Dec. 19, 2002.

BACKGROUND OF INVENTION

1. Field of the Invention

The present invention generally relates to equipment and process for cutting food products, such as coring, sectioning & dicing, etc., thereby reducing the size of the product.

2. Description of the Related Art

Various types of equipment are known for slicing, shredding and granulating food products such as vegetables, fruits and meat products. For slicing root vegetables into thin slices, such as when slicing potatoes to make potato chips, a widely-used machine is commercially available from the assignee of the present invention under the name Urschel Model CC. The Model CC relies on centrifugal forces to maintain the product engaged with a cutting head. Other known machines include those that deliver food products on a horizontal conveyor to a vertically-oriented cutting wheel, and those that rely on products vertically stacked within a feed tube to maintain contact with a horizontal cutting wheel. An example of a cutting apparatus that employs gravity to cause food products to pass through a cutting wheel is disclosed in U.S. Pat. No. 5,241,902 to Gangi. More particular, Gangi discloses an apparatus adapted to section fruit that has been cored, such that the product has a core hole that passes through the center of the product. Proper orientation of the product during sectioning relies on an inner guide shaft to be received in the core hole of a product as the product drops down through an annular-shaped passage defined by and between the inner guide and an outer guide that circumscribes the inner guide. The product engages multiple vertical rotary cutting blades during its fall to produce a sectioned product.

SUMMARY OF INVENTION

The present invention provides an apparatus and process for cutting food products, in which the products are fed single-file by gravity through a cutting means comprising one or more cutting elements. The apparatus makes use of means for contacting and positioning the products as drop through a feed passage prior to encountering the cutting means so as to produce size-reduced products of more uniform size.

The food product cutting apparatus generally includes cutting means comprising at least one cutting element disposed in a cutting plane that is not vertical, and means for individually delivering food products to the cutting means by causing the food products to free-fall through a feed passage and then free-fall through the cutting means entirely under the force gravity and on a path that is approximately normal to the cutting plane. The apparatus further includes means for contacting the food products and positioning the food products so that they free-fall on the path at a predetermined location within a cross-section of the feed passage as the food products free-fall through the feed passage and prior to encountering the cutting means so as to produce size-reduced products.

The method of this invention generally includes individually delivering food products to a cutting means comprising at least one cutting element disposed in a cutting plane that is not vertical by causing the food product to free-fall through a feed passage and then free-fall through the cutting means entirely under the force of gravity and on a path that is approximately normal to the cutting plane. As the products free-fall, they are contacted and positioned at a predetermined location within the cross-section of the feed passage prior to encountering the cutting means so as to produce size-reduced products.

The apparatus and method of this invention are capable of producing size-reduced products of substantially consistent size and shape. In each case, only the outer periphery of the food product need be contacted as it free-falls through the feed passage, thereby eliminating (though allowing for) the requirement to core the food product prior to being reduced. Other objects and advantages of this invention will be better appreciated from the following detailed description.

DETAILED DESCRIPTION

Figure 1:
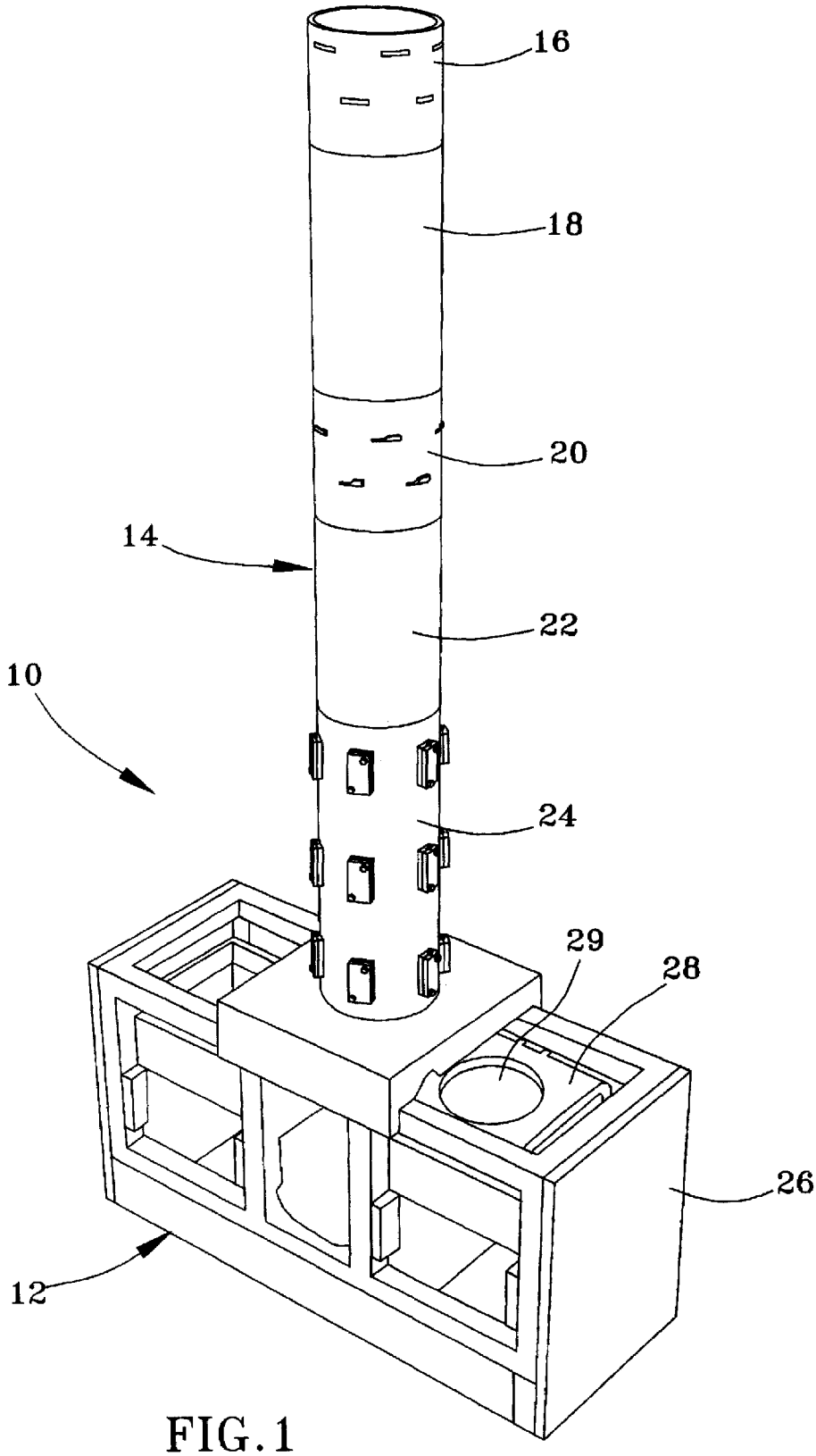
FIG. 1 is a perspective view of a cutting apparatus comprising a vertical feed tube and a horizontal cutting head in accordance with a first embodiment of this invention.

FIG. 1 shows a cutting apparatus 10 adapted to feed food products to a cutting unit 12 under the force of gravity. The apparatus 10 is particularly suited for precutting products, such as coring, sectioning & dicing, etc., to reduce the size of a product so that the product can be possibly accommodated by additional processing equipment. As the apparatus 10 is depicted in FIG. 1, products are fed in a vertical direction to the cutting unit 12 through a substantially vertical feed tube 14 that is shown as comprising five tube segments 16, 18, 20, 22 and 24. While five segments 16-24 are depicted, the apparatus 10 could operate with fewer or more tube segments. Any one or more of the segments 16-24 may be hinged (not shown) for ease of cleaning the feed tube 14 and to permit the removal of any products that might become lodged in the tube 14. The feed tube 14 is sized such that products are fed single-file to the cutting unit 12. In addition, while the feed tube 14 and the segments 16-24 are shown as having round cross-sections, the cross-sectional shapes of the tube 14 and its individual segments 16-24 could be adapted to have a variety of cross-sectional shapes suitable for different food products.

Figure 4:
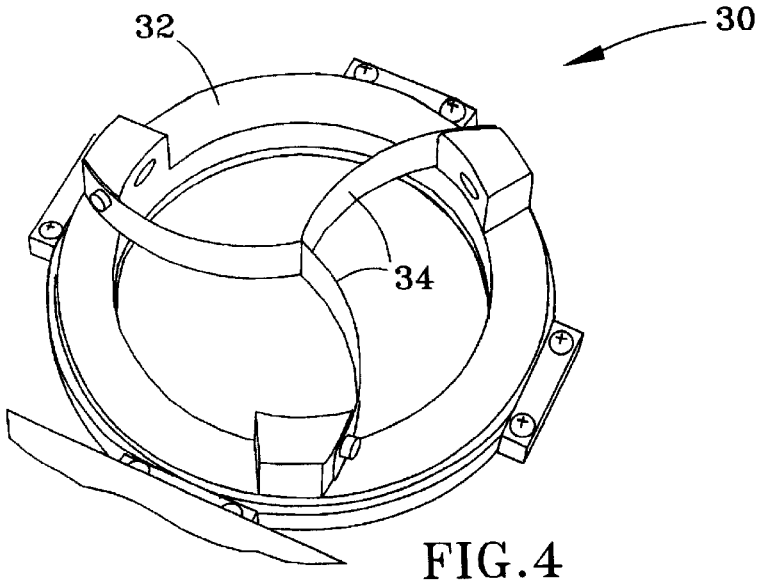
FIG. 4 is a perspective view of a stationary horizontal cutting head for the apparatus shown FIG. 1.

The cutting unit 12 is represented as comprising a housing 26 on which two horizontal cutting heads (an example of which is shown in FIG. 4) can be individually mounted on a sled 28. A mounting station 29 for receiving a cutting head is visible in FIG. 1 as an opening in the sled 28. A second mounting station for a second cutting head is not visible in FIG. 1 as a result of being positioned beneath the feed tube 14 to perform a cutting operation on products dropping down through the feed tube 14. The cutting heads are mounted on the sled 28 to permit uninterrupted changeover, such as when a head requires replacement or a different cut is required. Moving the sled 28 leftward (as viewed in FIG. 1) causes a cutting head positioned on the mounting station beneath the feed tube 14 to be displaced leftward, and positions the mounting station 29 visible in FIG. 1 beneath the feed tube 14. Various techniques can be used to move the sled 28, including automated and manual techniques known in the art.

FIG. 4 shows a suitable cutting head 30 for use with the apparatus 10 of this invention. The head 30 is represented as comprising an annular mounting ring 32 that supports a stationary three-bladed knife 34 whose blades are preferably thin and tensioned for rigidity. According to another preferred aspect of this embodiment of the invention, the blades of the knife 34 are double beveled to reduce the likelihood that products will become lodged in the cutting head 30. Finally, the knife 34 is preferably installed to lie in a plane approximately transverse to the axis of the feed tube 14 so that the blades of the knife 34 pass longitudinally through food products that have free-fallen through the feed tube 14. While a three-bladed knife 34 is depicted in FIG. 4, many other knife configurations could be used depending on desired operation, e.g., coring, dicing, etc.

Figure 5:
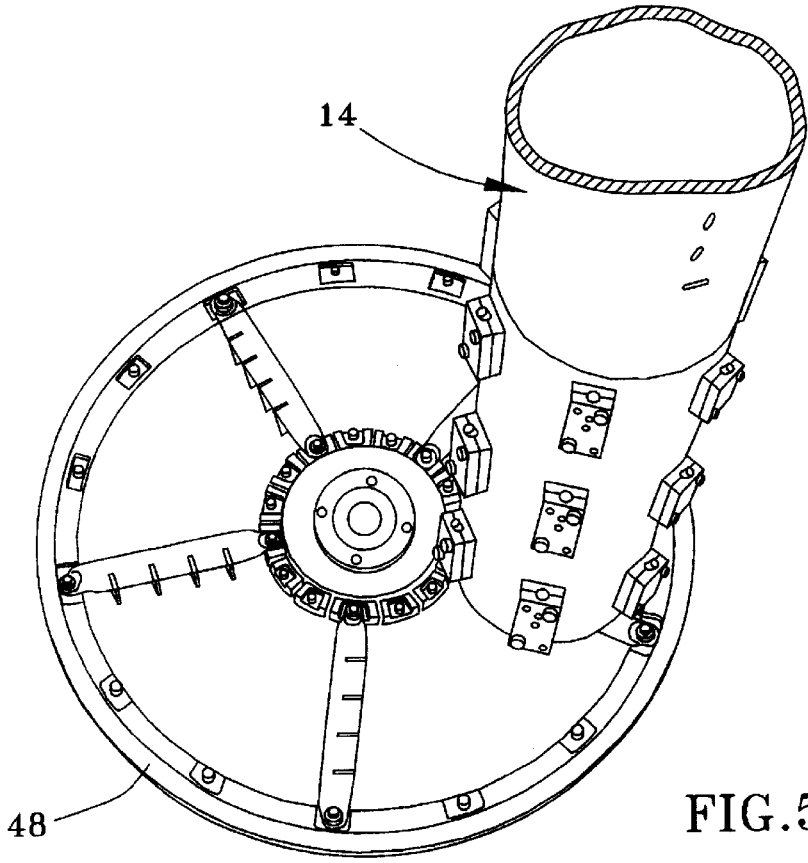
FIG. 5 is a perspective view showing the cutting apparatus of FIG. 1 equipped with a rotating horizontal cutting head in accordance with another embodiment of this invention.

FIG. 5 represents a rotary cutting wheel 48 that may be used in place of the stationary knife 34 of FIG. 4 to slice products horizontally as the products leave the tube 14. A suitable wheel for this purpose is disclosed in commonly-assigned U.S. Pat. No. 6,460,444. The cutting wheel 48 may also be used in combination with a stationary knife (e.g., 34 of FIG. 4) mounted in the sled 28, with the cutting wheel 48 mounted immediately below the cutting head 30 such that products vertically sectioned by the stationary knife 34 are immediately transversely sliced by the cutting wheel 48 to yield a processed product that is ready for packaging. In such an embodiment, the cutting wheel 48 is preferably disposed a distance from the stationary knife 34 a distance of at least equal to the diameters of the food products being processed in order to promote product feed-through. Alternatively or in addition to the cutting wheel 48, various other secondary devices could be positioned directly beneath the feed tube 14 or the cutting unit 12, such as to create other dimensional cuts (e.g., dicing cuts) or to move the processed products, e.g., a pneumatic plunger that pushes the processed products horizontally.

As evident from FIG. 1, the tube segments 16, 18, 20, 22 and 24 are stacked on top of each other to construct the feed tube 14. In practice, a suitable overall height for the feed tube 14 has been found to be about six feet, though it is foreseeable that shorter and taller feed tubes 14 could be successfully used. It can be appreciated that the height of the feed 14 must be sufficient to enable food products to gain enough vertical velocity to pass completely through the cutting head 30, and that the size and shape of the products and the configuration of the cutting head 30 influence will the height of the feed tube 14 required for this purpose. Furthermore, as will be discussed in reference to FIG. 8, the feed tube 14 can also slope, i.e., inclined from vertical, such as at an angle of about thirty degrees from vertical, yet still enable food products to achieve sufficient velocity for proper operation of the apparatus 10.

According to a preferred aspect of the embodiment of FIG. 1, the segments 16, 20 and 24 are equipped with a device 36 (FIGS. 2 and 3) for contacting and positioning food products at or near the central axis of the tube 14 as the products free-fall under the force of gravity toward the cutting unit 12. In this manner, if the stationary knife 34 of FIG. 4 is employed, the axis of the food products can be aligned with the point at which the blades of the knife 34 converge so as to yield food product sections of approximately equal size and shape. The tube segments 18 and 22 are preferably not equipped with a positioning device 36, as it has been demonstrated that improved centering of food products occurs if positioning devices 36 are spaced vertically apart so that the products are allowed to drop freely between adjacent "centering" segments 16, 20 and 24 in order to regain speed and stability. While an optimum distance that a product is allowed to free-fall between centering segments 16, 20 and 24 will presumably depend on the size and weight of the product, suitable results have been obtained by sizing the "non-centering" segments 18 and 22 so that the positioning devices 36 of the segments 16, 20 and 24 are vertically spaced about one to two feet (about 30 to 60 cm) apart.

Figure 2:
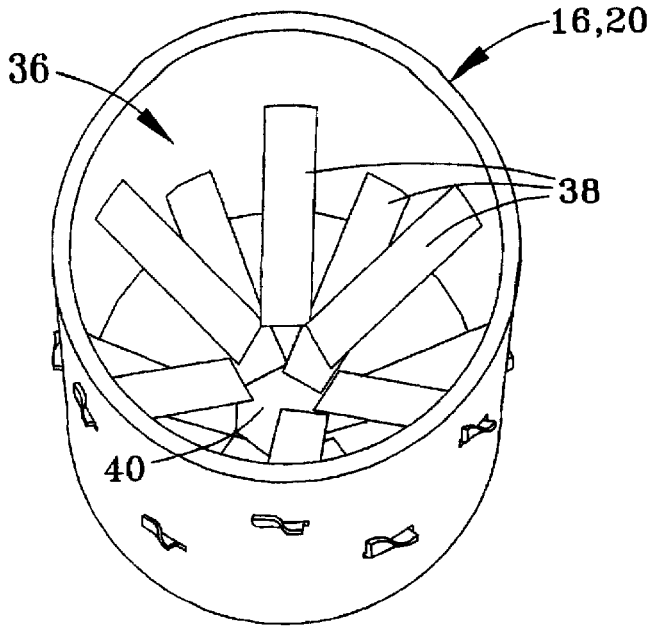
FIGS. 2 and 3 are perspective views of first and second centering segments of the feed tube shown FIG. 1.

FIG. 2 is an isolated view of one of the tube segments 16 and 20 of FIG. 1. The positioning device 36 of the segment 16/20 is represented in FIG. 2 as comprising a number of flat metal springs 38 that project radially inward and in a downward direction toward the central axis of the segment 16/20. The springs 38 are sufficiently resilient to deflect downward as food products drop down through the interior of the segment 16/20. The distal ends of the springs 38 define an opening 40 that is smaller than the products to be processed with the apparatus 10, so that an individual product is continuously contacted by more than one spring 38 as the product drops through the segment 16/20, with the effect that the product generally becomes oriented with its major (longitudinal) axis aligned substantially vertically with the central axis of the segment 16/20. As seen in FIG. 2, the springs 38 are arranged in two rows along the perimeter of the segment 16/20, with the springs 38 in the upper row being circumferentially offset from the springs 38 in the lower row. The vertical spacing of the rows of springs 38 is preferably such that the product dropping through the segment 16/20 is simultaneously contacted by springs 38 of both rows at some point as the product drops through the segment 16/20. Springs 38 arranged as shown in 2 and formed of a spring steel have been demonstrated to provide a suitable centering effect. However, it is foreseeable that flat metal springs having a variety of different shapes, spacings, etc. could be used. In addition, springs 38 could be adjustably mounted to the segment 16/20 so that the distance the springs 38 extend into the segment interior, as well as the rigidity the springs 38, can be tailored for the particular product.

Figure 3:
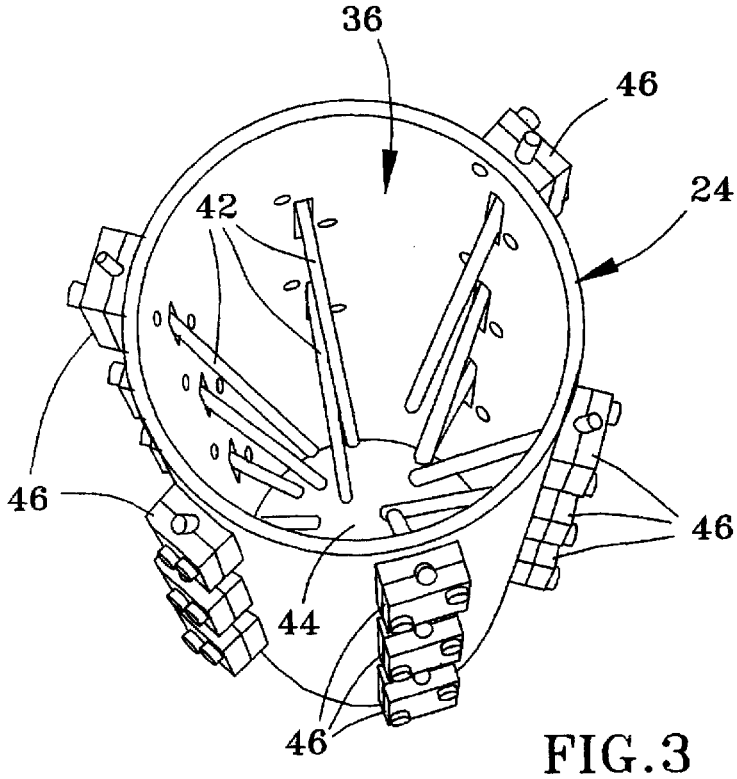

FIG. 3 is an isolated view of the lowermost tube segment 24 in FIG. 1. Instead of the flat metal springs 38 of FIG. 2, the positioning device 36 of the segment 24 comprises a number of cylindrically-shaped springs 42 formed of plastic, though metal round wire could also be used. As with the flat metal springs 38 of FIG. 2, the plastic springs 42 extend into the interior of the segment 24 at a downward angle so that the springs 42 must deflect downward to allow food products to drop down through the segment 24. The springs 42 are represented as being arranged in three circumferential rows and, in contrast to FIG. 2, vertically aligned columns. Similar to the metal springs 38 of FIG. 2, the distal ends of the springs 42 define an opening 44 that is sufficiently small so that a product is continuously contacted by more than one spring 42 as it drops through the segment 24, and the product is simultaneously contacted by springs 42 of adjacent rows at some point as the product free-falls through the segment 24, again with the result that the product is oriented with its major axis aligned substantially vertically with the axis of the segment 24. The springs 42 are shown as being secured to the segment 24 with blocks 46 that enable adjustment of the distance that each spring 42 projects into the interior of the segment 24, thereby adjusting the diameter of the opening 44 and the rigidity of the springs 42.

Figure 6:
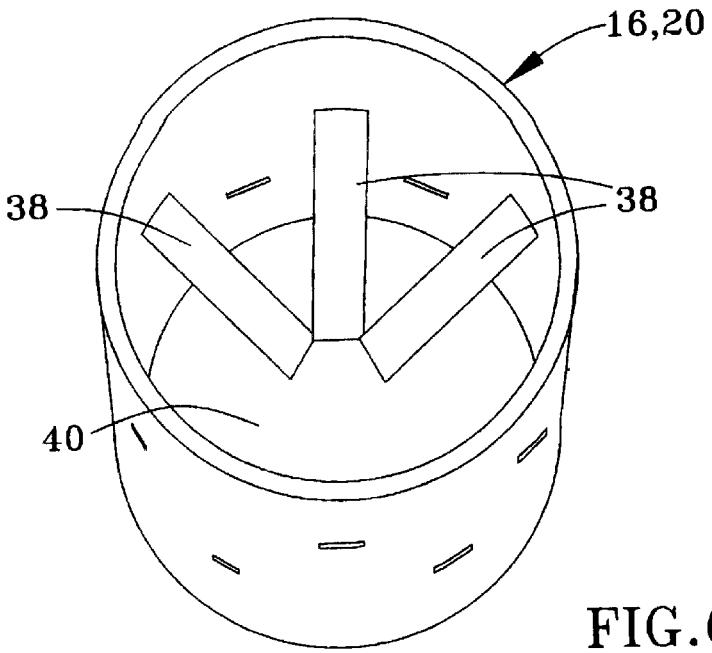
FIGS. 6 and 7 are perspective views of alternative embodiment for the feed tube segments shown FIG. 2.

The choice of segment design (segments 16 and 20 versus segment 24) may depend on the type of food products being handled. While FIG. 1 shows both flat metal and round plastic springs 38 and 42 used in the same apparatus 10, it is foreseeable that only one type of spring 38 or 42 would be used, and such springs could be formed of various materials. In addition, the number of segments equipped with a positioning device 36 could vary. For example, FIG. 6 shows an embodiment in which flat metal springs 38 are located along only about one-half of the circumference of a tube segment 16/20, such that the opening 40 through which the products drop is located along the wall of the segment 16/20. As a result, food products are urged into contact with the inner wall surface of the feed tube 14 as they drop, instead of being forced away from the wall surface and centered along the central axis of the tube 14.

Figure 7:
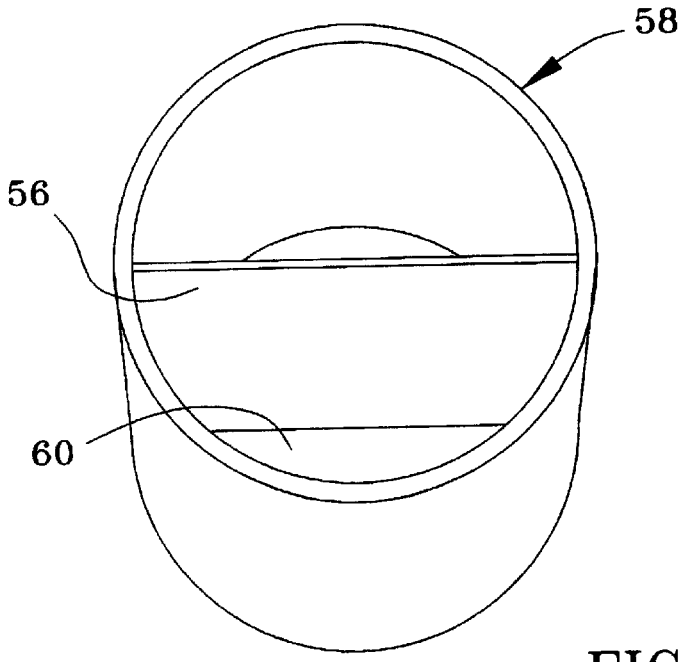

As another alternative, springs can be entirely omitted from the feed tube 14, such that products are in uninterrupted free-fall through the feed tube 14. One application for such an apparatus is halved products, e.g., melons. For this purpose, FIG. 7 represents a tube segment 58 modified to include a diametrical planar partition 56, thereby defining a semicircular passage 60 through which the products drop. Though shown as located at a diametrical chord of the tube segment 58, the partition 56 could be positioned elsewhere within the segment 58 to achieve a generally semicircular-shaped passage 60. Alternatively, the cross-sectional shape of the segment 58 could be modified to have the desired semicircular cross-sectional shape for positioning and orienting halved food products as they pass through the segment 58. In either case, the partition 56 (as a separate element added to tube segment 58 or as an integral wall portion of a semicircular-shaped tube segment) serves as a device for contacting a planar surface of a food product so as to orient and position the food product as it free-falls under the force of gravity toward the cutting unit 12. As a result of constructing the feed tube 14 of segments 58 of the type shown in FIG. 7, food products dropping through the tube 14 are not centered relative to the axis of the tube 14, but instead are positioned at a location within the cross-section of the feed tube 14 that is predetermined by the location of the partitions 56 within the segments 58.

Figure 8:
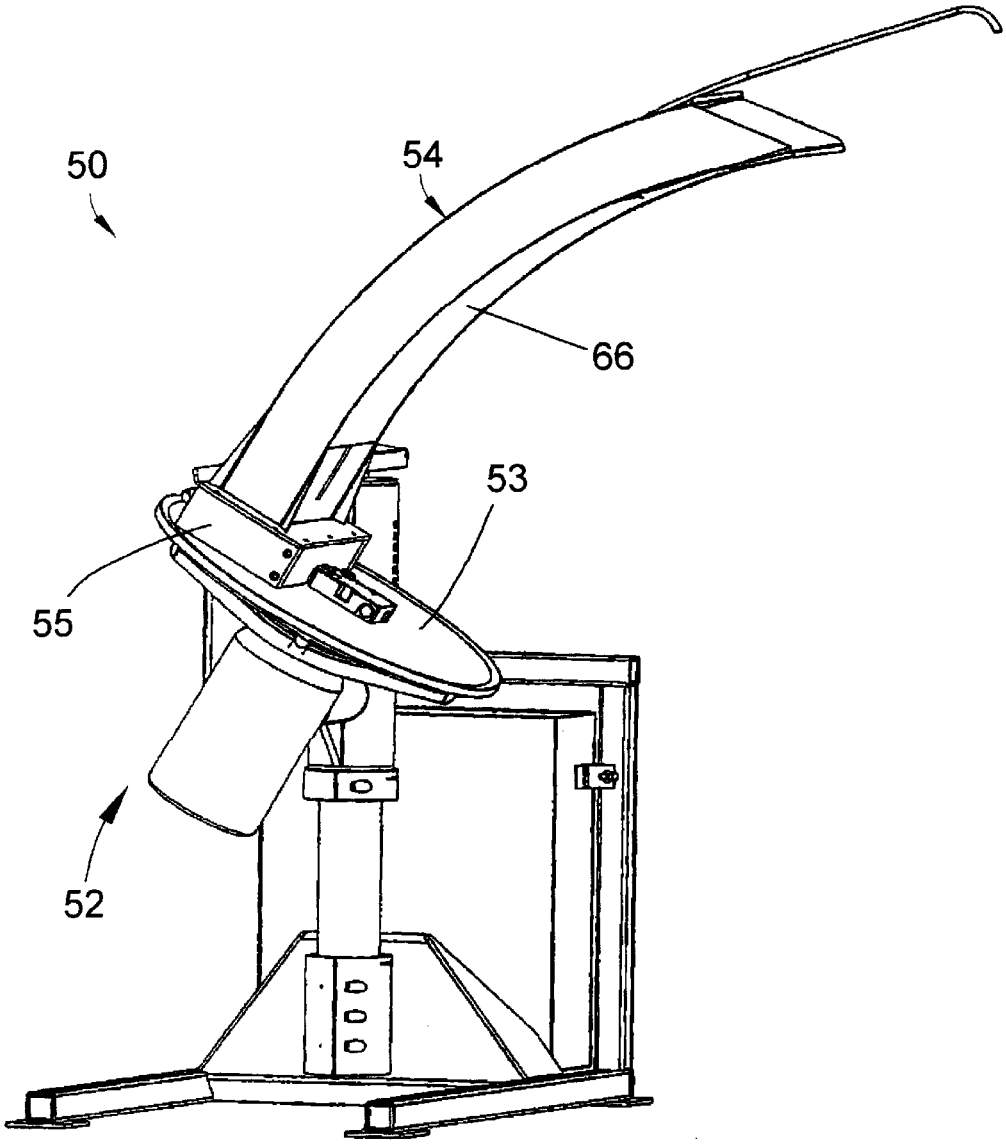
FIG. 8 is a perspective view of a cutting apparatus comprising a sloping feed tube in accordance with a second embodiment of this invention.

In FIG. 8, a cutting apparatus 50 is represented as having a feed tube 54 that is inclined from vertical, such as at an angle of about thirty degrees from vertical at a point where the tube 54 interfaces with a cutting unit 52. The tube 54 is represented as having a rectilinear cross-sectional shape, with a lower planar wall 66 of the tube 54 serving to contact a planar surface of a food product so as to orient and position the food product as it free-falls under the force of gravity toward the cutting unit 52. The cutting unit 52 is represented as comprising a rotary cutting unit 53 (e.g., containing the cutting wheel 48 of FIG. 5) that operates in a plane roughly transverse to the axis of the feed tube 54, and a stationary cutting unit 55 (e.g., containing the stationary knife 34 of FIG. 4) above the rotary cutting unit 53 for the purpose of making longitudinal cuts through the food products before they undergo transverse slicing with the rotary cutting unit 53. Optionally, the cutting wheel 48 could be oriented at an angle other than ninety degrees to the axis of the tube 54 for the purpose of making bias cuts. The embodiment of FIG. 8 can be equipped with springs 38 or 42 in accordance with previous embodiments to help stabilize the food products during descent. Alternatively or in addition, the apparatus 50 may be equipped with water jets in accordance with commonly-assigned U.S. patent application Ser. No. 10/072,494 for the purpose of product stabilization.

Figure 9:
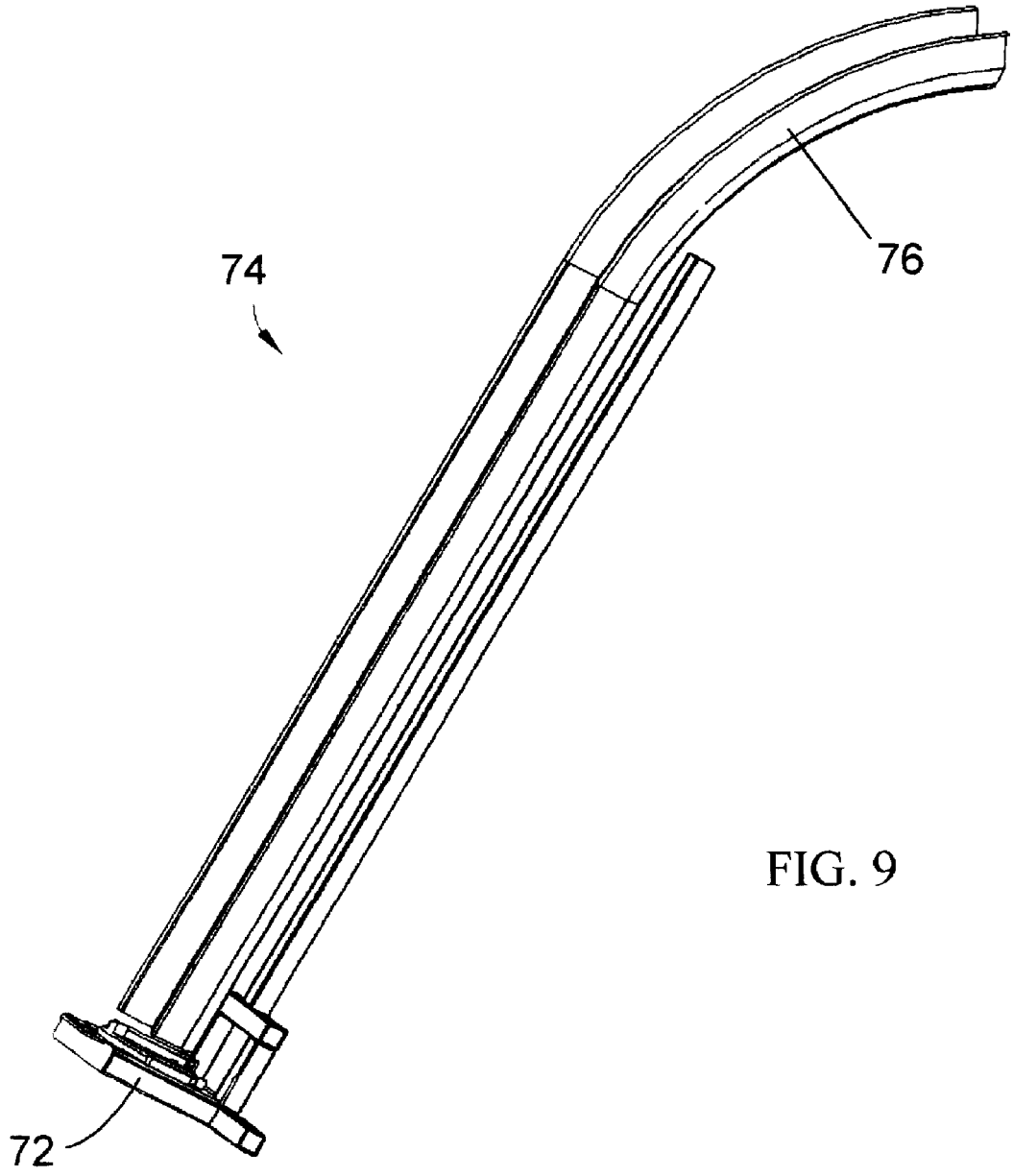
FIG. 9 is a perspective view of an alternative sloping feed tube for the apparatus of FIG. 8.

Finally, FIG. 9 depicts an alternative configuration for a feed passage 74 for use with the apparatus 50 of FIG. 8. The feed passage 74 is defined by a generally U-shaped or V-shaped trough 76. In accordance with previous embodiments of the invention, the shape of the trough 76 is designed to provide continuous contact with food products falling single-file within the trough 76 toward a cutting unit 72 (represented in FIG. 9 as being of the type equipped with stationary knives) such that the food products are properly positioned and oriented relative to the cutting unit 72.

While the invention has been described in terms of preferred embodiments, it is apparent that other forms could be adopted by one skilled in the art. For example, the cutting unit (particularly the cutting wheel 48) can be oriented at an angle other than ninety degrees to the axes of the tubes 14, 54 and 74 for the purpose of making bias cuts, and the physical configurations of the cutting apparatuses could differ from those shown. Therefore, the scope of the invention is to be limited only by the following claims.

The invention claimed is:

1. A method of cutting food product, the method comprising the steps of:

providing a cutting means comprising at least one cutting element disposed in a cutting plane that is not vertical;

individually delivering food products to the cutting means by causing the food products to free-fall through a feed passage and then free-fall through the cutting means entirely under the force of gravity and on a path that is approximately normal to the cutting plane; and contacting the food products and positioning the food products so that they free-fall on the path at a predetermined location within a cross-section of the feed passage as the food products free-fall through the feed passage and prior to encountering the cutting means so as to produce size-reduced products of substantially consistent size and shape;

wherein the contacting and positioning step comprises contacting and positioning the food products with a plurality of resilient members extending radially inward into the feed passage toward a central axis thereof.

2. The method according to claim 1, wherein the cutting means comprises multiple stationary blades disposed in the cutting plane and joined together at a point aligned with the predetermined location within the cross-section of the feed passage, the method further comprising the step of making approximately longitudinal cuts through the food products with the multiple stationary blades.

3. The method according to claim 1, wherein the cutting means comprises a cutting wheel rotating in the cutting plane, the method further comprising the step of making transverse cuts through the food products with the cutting wheel as the cutting wheel rotates.

4. The method according to claim 1, wherein the cutting means comprises:

multiple stationary blades disposed in the cutting plane and joined together at a point aligned with the predetermined location within the cross-section of the feed passage, wherein the delivering step comprises the multiple stationary blades making substantially longitudinal cuts through the food products; and a cutting wheel rotating in a plane beneath the multiple stationary blades, wherein the delivering step further comprises the cutting wheel making transverse cuts through the food products.

5. The method according to claim 4, further comprising the step of disposing the cutting wheel from the multiple stationary blades a distance of at least equal to a diameter of the food products.

6. The method according to claim 1, wherein the resilient members are uniformly distributed along an inner perimeter of the feed passage so as to center the food products passing therethrough at the central axis of the feed passage.

7. The method according to claim 1, wherein the feed passage and the path therein are inclined from vertical so that the free-fall of the food products is also inclined from vertical.

8. The method according to claim 7, wherein the feed passage and the path therein are oriented at an angle of about 30 degrees from vertical so that the free-fall of the food products is also at an angle of about 30 degrees from vertical.

9. The method according to claim 7, further comprising the step of forming the feed passage to have a planar surface.

10. The method according to claim 9, wherein the contacting and positioning step comprises orienting the feed passage so that gravity causes a planar surface of each of the food products to contact the planar surface of the feed passage as the food products pass through the feed passage.

11. A method of cutting food product, the method comprising the steps of:

individually delivering food products to a cutting means comprising at least one cutting element disposed in a cutting plane that is not vertical by causing the food products to free-fall through a feed passage and then free-fall through the cutting means entirely under the force of gravity and on a path that is approximately normal to the cutting plane; and contacting the food products and positioning the food products with a plurality of resilient members extending radially inward into the feed passage toward a central axis thereof, the resilient members causing the food products to free-fall on the path at a predetermined location within a cross-section of the feed passage as the food products free-fall through the feed passage and prior to encountering the cutting means so as to produce size-reduced products of substantially consistent size and shape.

12. The method according to claim 11, wherein the cutting means comprises multiple stationary blades disposed in the cutting plane and joined together at a point aligned with the predetermined location within the cross-section of the feed passage, the method further comprising the step of making approximately longitudinal cuts through the food products with the multiple stationary blades.

13. The method according to claim 11, wherein the cutting means comprises a cutting wheel rotating in the cutting plane, the method further comprising the step of making transverse cuts through the food products with the cutting wheel as the cutting wheel rotates.

14. The method according to claim 11, wherein the cutting means comprises multiple stationary blades disposed in the cutting plane and joined together at a point aligned with the predetermined location within the cross-section of the feed passage, and a cutting wheel rotating in a plane beneath the multiple stationary blades, the method further comprising the steps of cutting the food products in a longitudinal direction with the multiple stationary blades and then cutting the food products in a transverse direction with the cutting wheel, the food products passing completely through the multiple stationary blades before engaging the cutting wheel.

15. The method according to claim 11, wherein only the outer peripheries of the food products are contacted as the food products free-fall through the feed passage.

16. The method according to claim 11, wherein the feed passage and the path therein are oriented substantially vertically and the contacting and positioning step comprises centering the food products at a central axis of the feed passage.

17. The method according to claim 11, wherein the feed passage and the path therein are inclined from vertical, and the feed passage has a planar surface that contacts a planar surface of each of the food products under the force of gravity as the food products pass through the feed passage.

* * * * *